US006476720B2

(12) United States Patent
Andersen et al.

(10) Patent No.: US 6,476,720 B2
(45) Date of Patent: Nov. 5, 2002

(54) SECURITY TAG DEACTIVATION SYSTEM

(75) Inventors: Kenneth Andersen, Bergenfield, NJ (US); Gerard F. Murphy, Upper Montclair, NJ (US); Vance Daddi, Redwood City, CA (US)

(73) Assignee: ATS Money Systems, Inc., Englewood, NJ (US)

( * ) Notice: Subject to any disclaimer, the term of this patent is extended or adjusted under 35 U.S.C. 154(b) by 0 days.

(21) Appl. No.: 09/969,285

(22) Filed: Oct. 2, 2001

(65) Prior Publication Data

US 2002/0011933 A1 Jan. 31, 2002

Related U.S. Application Data

(62) Division of application No. 09/609,952, filed on Jul. 5, 2000, now Pat. No. 6,333,692.
(60) Provisional application No. 60/142,630, filed on Jul. 6, 1999.

(51) Int. Cl.[7] ..... G08B 13/14
(52) U.S. Cl. ..... 340/572.1; 340/572.3; 340/572.4; 340/572.6; 340/572.7; 340/568.1; 340/568.7
(58) Field of Search ..... 340/572.1, 572.3, 340/572.4, 572.6, 572.7, 568.1, 568.7

(56) References Cited

U.S. PATENT DOCUMENTS

| | | | | |
|---|---|---|---|---|
| 3,624,631 A | | 11/1971 | Chomet et al. | 340/280 |
| 3,810,147 A | | 5/1974 | Lichtblau | 340/280 |
| 4,881,061 A | | 11/1989 | Chambers | 340/568 |
| 5,059,951 A | * | 10/1991 | Kaltner | 340/572 |
| 5,594,228 A | | 1/1997 | Swartz et al. | 235/383 |
| 5,635,906 A | | 6/1997 | Joseph | 340/572 |
| 5,640,002 A | | 6/1997 | Ruppert et al. | 235/472 |
| 5,745,036 A | | 4/1998 | Clare | 340/572 |
| 5,878,211 A | * | 3/1999 | Delagrange et al. | 395/186 |
| 5,955,951 A | * | 9/1999 | Wischerop et al. | 340/572.8 |
| 5,963,134 A | | 10/1999 | Bowers et al. | 340/572.1 |
| 6,154,135 A | * | 11/2000 | Kane et al. | 340/572 |
| 6,154,137 A | * | 11/2000 | Goff et al. | 340/572.4 |

* cited by examiner

*Primary Examiner*—Daniel J. Wu
*Assistant Examiner*—Tai T. Nguyen
(74) *Attorney, Agent, or Firm*—Duane Morris LLP

(57) ABSTRACT

A method for tracking deactivation of security devices being associated with items to be sold, each of the items being associated with a tracking identifier. The method includes determining a number of security tag deactivations which should occur using select ones of the identifiers and determining a number of actual security tag deactivations which occurred. The method then compares the number of actual security tag deactivations to the number of security tag deactivations which should have occurred, and generates an output when the comparing results in an inconsistency therebetween.

6 Claims, 14 Drawing Sheets

IN-STORE PROCESSOR

Database Layout

Statistics Table
UPC
Store
Register
Associate
Transaction ID
Department
Date and Time
Tagged Item
Tag Found
Quantity
Between Transactions Weekly Stats
UPC
Store
Register
Associate
Deparment
Year
Week
Tagged Item
Tag Found
Quantity
Between Transactions Return/Void Table
UPC
Store
Register
Associate
Transaction ID
Department
Date
Quantity
Return Monthly Stats
UPC
Store
Register
Associate
Department
Year
Month
Tagged Item
Tag Found
Quantity
Between Transactions Daily Stats
UPC
Store
Register
Associate
Department
Date
Tagged Item
Tag Found
Quantity
Between Transactions

Fig. 3

Messages Between POS and TAG Deactivator

Enable Deactivator

Disable Deactivator

Request Deactivation Count

Request System Status

Down Load Firmware Revision

Fig. 6

Packet Header

| DESCRIPTION | SIZE | COMMENTS |
|---|---|---|
| length | word | Inclusive length of this packet |
| packet sequence number | word | this packet number, starting at 1 |
| number of packets | word | number of packets in this chain - always set to 1 |

Fig. 7A

Addressed Message Header

| DESCRIPTION | SIZE | COMMENTS |
|---|---|---|
| signature | word | validation field always 0x9176 |
| length | word | length of message following this header |
| message type | word | 0 = request<br>1 = response |
| destination | dword | 0 |

Fig. 7B

Service Request Header

| DESCRIPTION | SIZE | COMMENTS |
|---|---|---|
| signature | word | 0x3a0f |
| length | word | length of this message including this header |
| Service ID | word | defines the service requested in this message |
| Function ID | word | defines the function requested in this message. This field combined with Service ID is used to determine the contents of the message |
| sequence number | dword | sequence number for this message |
| register id | dword | address |
| process id | word | |
| op id | dword | operator id |

Fig. 7C

Service Response Header

| DESCRIPTION | SIZE | COMMENTS |
|---|---|---|
| signature | word | 0x1c2e |
| length | word | length of this message including this header |
| request header | 22 bytes | copy of the Service Request Header from the request |
| result | word | result code for this request. Varies by message. |

Fig. 7D

| DESCRIPTION | SIZE | COMMENTS |
|---|---|---|
| lookup type | short | Always 0 |
| item | 6 bytes | BCD |

Fig. 8A

| DESCRIPTION | SIZE | COMMENTS |
|---|---|---|
| sku | 6 bytes | BCD |
| price | long | 3 decimal places |
| prompt for price | 1 byte | 0 = don't prompt |
| department | short | |
| /for quantity | short | |
| description | 16 bytes | ASCII |
| non-sell flag | byte | 0 = sellable |
| tax type | byte | 0 = no tax<br>1 = low tax<br>2 = high tax<br>3 = misc. tax<br>4 = prompt tax |
| discount flag | 1 byte | 0 = discountable |
| target/qualifier | 1 byte | 0 = neither<br>1 = qualifier<br>2 = target<br>3 = both |
| tagged item | 1 byte | 0 = not tagged<br>1 = tagged<br>2 = magnetic media |
| promo id | 3 bytes | BCD all zeroes if no promo |
| /for qty. | short | for qty. for promo |
| mdt | 1 byte | 0 = new price<br>1 = $ off<br>2 = % off |
| amount | long | 1 decimal place if amount<br>3 decimal places if percent |
| group number | 2 bytes | BCD all zeroes if no group |
| mdt | 1 byte | 0 = new price<br>1 = $ off<br>2 = % off<br>3 = Dollar off least<br>4 = Percent off all |
| /for qty. | short | for qty. of group tier |
| amount | long | 3 decimal places |
| /for qty. | short | for qty. of group tier |
| amount | long | 3 decimal places |
| /for qty. | short | for qty. of group tier |
| amount | long | 3 decimal places |
| /for qty. | short | for qty. of group tier |
| amount | long | 3 decimal places |
| /for qty. | short | for qty. of group tier |
| amount | long | 3 decimal places |
| global number | 2 bytes | BCD all zeroes if no global |
| /for qty. | short | for qty. of group tier |
| mdt | 1 byte | 0 = new price<br>1 = $ off<br>2 = % off |
| amount | long | 3 decimal places |

Fig. 8B

| DESCRIPTION | SIZE | COMMENTS |
|---|---|---|
| Terminal ID | long | ID for the requesting POS |

Fig. 8C

| DESCRIPTION | SIZE | COMMENTS |
|---|---|---|
| Status | long | 0 = No Load<br>1 = Load |
| Length | long | length of loader recorder |
| Loader Record | variable | only present if load requested |
| Length | long | length of load file |
| Load File | variable | only present if load requested |

Fig. 8D

| DESCRIPTION | SIZE | COMMENTS |
|---|---|---|
| Terminal ID | long | ID for the requesting POS |

Fig. 8E

| DESCRIPTION | SIZE | COMMENTS |
|---|---|---|
| Terminal ID | long | ID for the requesting POS |
| Store | short | Store Number for this POS |
| Associate | long | Associate ringing this sale/return |
| Tran ID | short | Transaction ID for this sale |
| Department | short | Department for this UPC |
| UPC | 20 bytes | UPC scanned/entered or misfiring or there was no item associated with the deactivation |
| Date | 6 characters | Business Date |
| Hour | 1 byte | Hour of the sale |
| Minute | 1 byte | Minute of the sale |
| Second | 1 byte | Second of the sale |
| Quantity | 1 byte | The quantity of items sold |
| Tagged | 1 byte | If this was a tagged item as flagged in the PLU record |
| TagFound | 1 byte | The number of deactivations that occured |
| Between | 1 byte | 0 = within a transaction<br>1 = between transactions |

Fig. 8F

| DESCRIPTION | SIZE | COMMENTS |
|---|---|---|
| Terminal ID | long | ID for the requesting POS |
| Store | short | Store Number for this POS |
| Associate | long | Associate ringing this sale/return |
| Tran ID | short | Transaction ID for this sale |
| Department | short | Department for this UPC |
| UPC | 20 bytes | UPC scanned/entered |
| Date | 6 characters | Business Date |
| Quantity | 1 byte | The quantity of items sold |
| Tagged | 1 byte | If this was a tagged item as flagged in the PLU record |

Fig. 8G

| DESCRIPTION | SIZE | COMMENTS |
|---|---|---|
| Terminal ID | long | ID for the requesting POS |
| Store | short | Store Number for this POS |
| Associate | long | Associate ringing this sale/return |
| Tran ID | short | Transaction ID for this sale |
| Department | short | Department for this UPC |
| UPC | 20 bytes | UPC scanned/entered or misfiring or there was no item associated with the deactivation |
| Date | 6 characters | Business Date |
| Quantity | 1 byte | The quantity of items sold |

Fig. 8H

SECURITY TAG DEACTIVATION SYSTEM

RELATED APPLICATION

This application is a divisional of U.S. patent application Ser. No. 09/609,952, filed Jul. 5, 2000 now U.S. Pat. No. 6,333,692.

This application claims the benefit of U.S. Provisional Application No. 60/142,630, entitled "SECURITY TAG DEACTIVATION SYSTEM", filed on Jul. 6, 1999, the entire disclosure of which is hereby incorporated by reference.

FIELD OF THE INVENTION

The present invention relates generally to security devices and more particularly to an improved security tag tracking and deactivation system.

BACKGROUND OF THE INVENTION

As is known, loss prevention represents a significant challenge to today's retailer. In order to deter customers from walking off with merchandise, various devices have been developed such as electronic article surveillance devices, generally referred to as a security tags, which are used by retailers to prevent unauthorized removal or theft of consumer products from retail locations, i.e. stores. Generally, each security tag is designed so that it may be easily attached to or inserted into consumer product packaging. Typically, each security tag, using deactivation means, can be easily and efficiently deactivated without offending the customer, delaying check-out lines, or damaging the product. Typically security tags fall under either of two categories, radio-frequency ("RF") deactivated tags or magnetic tags which are deactivated by degaussing.

In such systems, a transmitter operates substantially continuously in the area of a checkpoint at a resonant frequency of a security tag circuit attached to the merchandise. When an article of merchandise bearing a security tag passes through the checkpoint, the tag begins to resonate from the transmitted energy, resulting in actuation of audible and/or visible alarms for example.

However, once a piece of merchandise has been purchased, it is necessary either to remove or deactivate the security tag so that the merchandise can be removed from the store. An example of a suitable device and security tag is presented in U.S. Pat. No. 3,624,631, which teaches a pilferage control system including a passive tuned circuit, which activates an alarm, the entire disclosure of which is hereby incorporated by reference as if being set forth in its entirety herein. To prevent activation of the alarm by tags on purchased merchandise, each passive tuned circuit of that system is provided with a fusible link, which is opened when the circuit is exposed to energy above a predetermined level. Thus, upon legitimate purchase of security tagged merchandise, the tuned circuit is deactivated by exposing the security tag to sufficient electromagnetic energy to destroy the fusible link.

Similarly, U.S. Pat. No. 3,810,147 teaches an alternative electronic security system, which uses multi-frequency resonant tag circuits having distinct frequencies for detection, and for deactivation, the entire disclosure of which is also hereby incorporated by reference herein. Therein, a deactivation frequency is applied to a security tag for the purpose of disarming it by rupturing a fusible link. This destroys the resonant properties of the tag at the detection frequency so that the deactivated security tag produces no alarm when passing through an exit of the store for example.

However, each of these systems and other systems currently in use fail to address additional problems related with the use of security tags. One such problem is known to those in retail as "sweet-hearting". "Sweet-hearting" can be summarized as deactivating a security tag for a device that has not been properly purchased. After this improper deactivation of the security tag, usually by a store employee, (e.g. a checkout clerk), an individual can remove the item from the store without purchasing it or activating the alarm. In this way, the security system has been effectively circumvented.

Another problem associated with the use of security tags results from improper tagging of merchandise. Security tags are typically either attached to merchandise by store employees or inserted into product packaging by a manufacturer at an additional charge to the retailer. Either way, the retailer has in effect paid for each of those products to be tagged with a security tag. Presently, there is no way for a retailer to easily and accurately ascertain whether each of those products which should have been tagged in fact were.

Further, when retail stores are at their busiest, cashiers often do not strictly adhere to deactivation procedures. Consequently, there results an increased number of false alarms, as security tags attached to properly purchased items are not passed over a deactivating unit to deactivate the security tag, thus causing a trip of the alarm system at an exit for example. This results in customer embarrassment and inconvenience, which is of course undesirable. Further, as the number of false alarms increases, the effectiveness of the security tags decreases as employees become desensitized to the alarm. Also, a deactivation device can fail to effectively deactivate a security tag thus further aggravating the situation, as a cashier usually has no way of knowing whether a particular security tag has been effectively deactivated or not.

Further yet, there exist many consumer products which are sensitive to particular deactivation techniques, such as degaussing. One such example is video tapes. If a video tape is exposed to a degaussing field it is well known the tape may be damaged. Accordingly, there is a need to identify these types of items and prevent their damage by the security tag deactivation device.

Accordingly, it is an object of the present invention to resolve these shortcomings of the prior art devices and systems, regardless of type, without substantially degrading the efficiency of existing checkout procedures.

SUMMARY OF INVENTION

A method for tracking deactivation of security devices being associated with items to be sold, each of the items being associated with a tracking identifier, the method including the steps of: determining a number of security tag deactivations which should occur using select ones of the identifiers; determining a number of actual security tag deactivations which occurred; comparing the number of actual security tag deactivations to the number of security tag deactivations which should occur; and, generating an output when the comparing results in an inconsistency therebetween.

BRIEF DESCRIPTION OF THE DRAWINGS

Various other objects, features and advantages of the invention will become more apparent by reading the following detailed description in conjunction with the drawings, which are shown by way of example only, wherein:

FIG. 3 is an exemplary view of a layout of a relational database employing parameter data transacted within the expert system in accordance with the present invention;

FIG. 6 provides an exemplary illustration of types of messages between the POS processor and tag deactivator units;

FIG. 7*a* provides an exemplary illustration of a packet header message format according to an embodiment of the present invention;

FIG. 7*b* provides an exemplary illustration of an addressed message header format according to an embodiment of the present invention;

FIG. 7*c* provides an exemplary illustration of a service request header format according to an embodiment of the present invention;

FIG. 7*d* provides an exemplary illustration of a service response header format according to an embodiment of the present invention;

FIGS. 8*a*–8*b* provide exemplary message formats associated with a lookup request and response message, respectively, according to the present invention;

FIGS. 8*c*–8*d* provide exemplary message formats associated with a load status service request and response message according to the present invention;

FIG. 8*e* provides an exemplary message format associated with an update load status request message according to the present invention;

FIG. 8*f* provides an exemplary message format associated with a tag status service request message according to the present invention;

FIG. 8*g* provides an exemplary message format associated with a return tag status service request message according to the present invention; and, FIG. 8*h* provides an exemplary message format associated with a void tag status service request message according to the present invention.

DETAILED DESCRIPTION OF THE INVENTION

Generally, the present invention takes the form of a security tracking and tag deactivation system including a first computer unit having an input for receiving a data item indicative of an item to be purchased, a processor for obtaining information associated with that purchase item from a memory device, and a counter for tracking the number of data items received at the input. A deactivating device is responsive to signals from the first computer for deactivating a security tag associated with the item to be purchased. The deactivating device further includes a deactivating counter for tracking the number of deactivations performed for a given transaction and providing the deactivating counter values to the first computer when requested. The first computer performs a comparison of the number of counts associated with its tracking of the data items received at its input with the number of deactivation counts from the deactivator unit. When the count values are not equal the first computer transmits a message to an in store processor indicating the discrepancy. The discrepancy is stored in memory and associated with the particular data item, purchase item, vendor identity, and other statistical data to enable discrepancy reports to be generated which correlate the number of items purchased with the number of items which were deactivated. The first computer unit further includes software functionality which determines whether a particular item is of the type which should not be deactivated by the deactivating unit, and transmits a disable message to the deactivator to cause it to be disabled, thereby protecting the product purchased, such as a magnetic tape, from the harmful effects of an inadvertent deactivation attempt.

Before embarking on a detailed discussion the following should be understood. Systems currently in use for scanning, deactivating, and tracking items such as store merchandise and other articles are not integrated in a manner so as to effectively utilize information available within the system. In the present invention as will be described below, information concerning items to be purchased is determined and/or made available at a first processing computer and correlated with information made available at a tag deactivator unit in order to discern additional information regarding those items that was previously unavailable. Such information includes a correlation of the number of purchases of particular items and an associated number of security tag deactivations corresponding to those items, in addition to information associated with a particular item to be purchased which enables activation or deactivation of a security tag scanning/deactivating unit.

Figure 1:
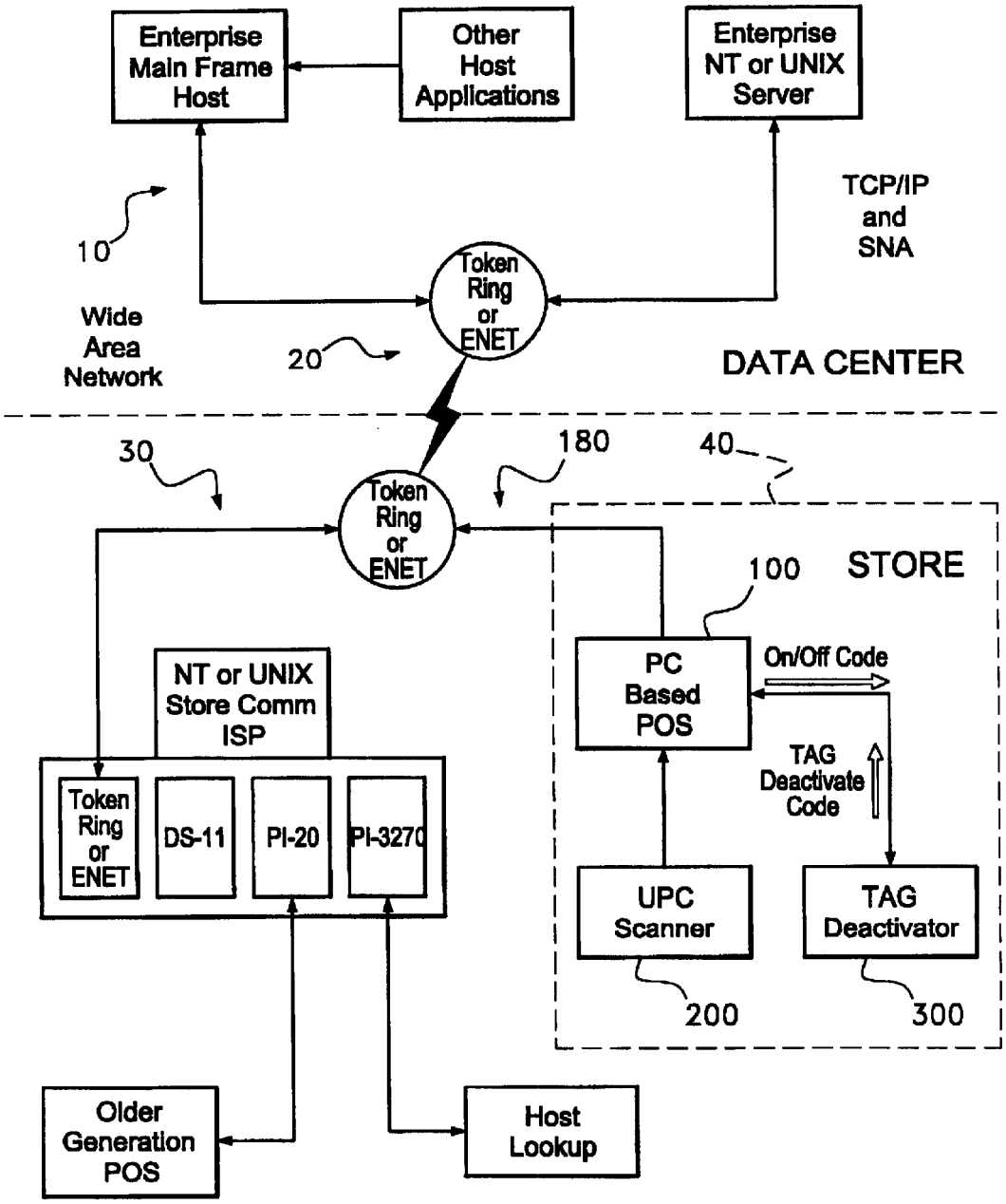
FIG. 1 is an exemplary illustration of a distributed networked configuration in which the expert tag deactivation system of the present invention is embodied.

Referring now to FIG. 1, there is shown a distributed network system 1 in which the security tag deactivation system of the present invention is embodied. The network system 1 comprises a data center storage facility 10 which may be for example, an enterprise main frame host unit or a MICROSOFT NT or UNIX server system, or any other suitable operating system platform, coupled over communication medium 20 such as a Token Ring or Ethernet system to an in-store processor unit (ISP) 30. The ISP 30 may be for example, an NT or UNIX application server. The in-store processor 30 includes a database of relational data such as price look up tagged items, quantities of merchandise items, and the like for use within the security tracking and deactivation system. A PC-based point of sale unit ("POS") 100 comprising a PC-based computer is part of the tracking and deactivation system 40, which further includes a tag deactivator unit 300 for deactivating items which are scanned either manually into the PC based POS unit 100 or via a scanner 200. The deactivator unit 300 may be any of the conventional types of deactivators which operate via use of RF frequencies, electromagnetics (e.g. degaussing), or other methods to cause deactivation of a security device or tag. The deactivator 300 also includes a counter for tracking and maintaining in memory the number of deactivations occurring within a given transaction.

Figure 2:
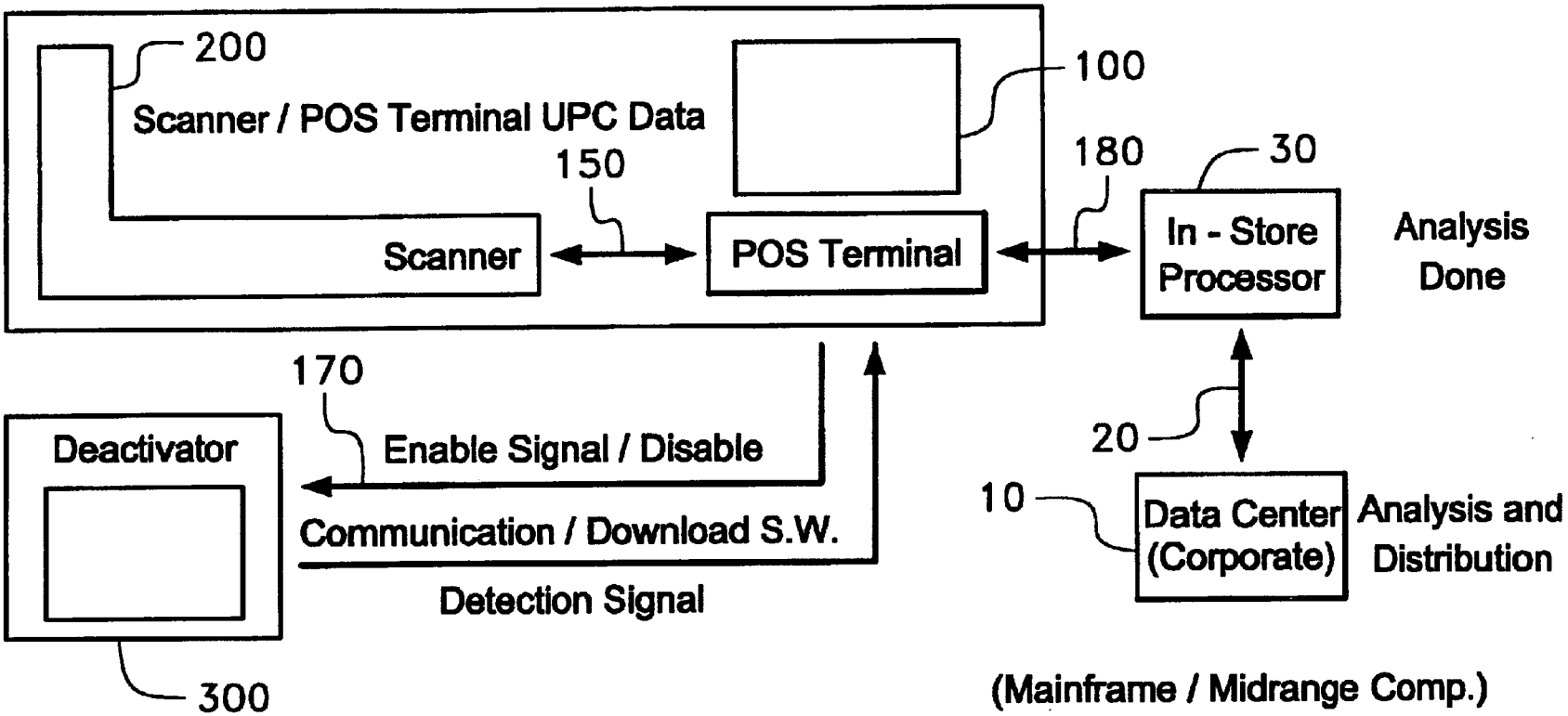
FIG. 2 is an exploded view of the expert tag deactivation system and components thereof according to a preferred embodiment of the present invention.

FIG. 2 provides a more detailed view of the tracking and deactivation system portion 40 wherein the POS terminal 100 communicates with scanner 200 via communication line 150. Tag deactivator unit 300 is in electrical communication with POS 100 over communication line 170 for providing serial instructions to and from the deactivator unit 300. Information between POS terminal 100 and in-store processor 30 is communicated via bi-directional communication line 180. As previously mentioned, the ISP 30 is in communication with the data center 10 via communication link 20 such as a wide area network. Thus there exists electrical connectivity between the PC based POS unit 100 and the in-store processor 30 and ultimately back to the host mainframe unit 10. The discussion which follows concerns the communication and processing associated with the POS computer unit 100 and tag deactivator 300 for transmitting information to the in-store processor 30.

It should be noted that as part of the POS 100—tag deactivator 300 transaction processing, a UPC code, or SKU, which is stored in a database either on the PC based POS 100 or at in-store processor 30 is used for correlating or identifying an item scanned as a tagged item which, therefore, should be properly deactivated by the deactivating unit 300. A POS look up function of the UPC code allows one to make an inference regarding what tag was deactivated when the scanning and deactivation procedure occurs.

Referring again to FIG. 2, it is shown that PC based POS terminal 100 communicates via serial instructions with the deactivator 300 to provide an enable/disable signal for either initiating or terminating, e.g. activating/deactivating the deactivator unit 300. The tag deactivator unit 300 is typically physically located next to the register portion of the POS computer unit 100. When an item of merchandise is to be purchased, the item includes a tag having a UPC code associated with the item. The UPC code associated with the item to be purchased is then either scanned via scanning unit 200 or is manually entered (via a keyboard entry) into POS 100 and stored in memory. The POS 100 correlates the particular UPC code scanned or entered with a corresponding vendor and item of merchandise so as to enable one to ascertain what the scanned item is as well as the source of the item. FIG. 3 provides an exemplary database layout of various tables for correlating and tracking the information associated with scanning and deactivation processing.

Figure 4:
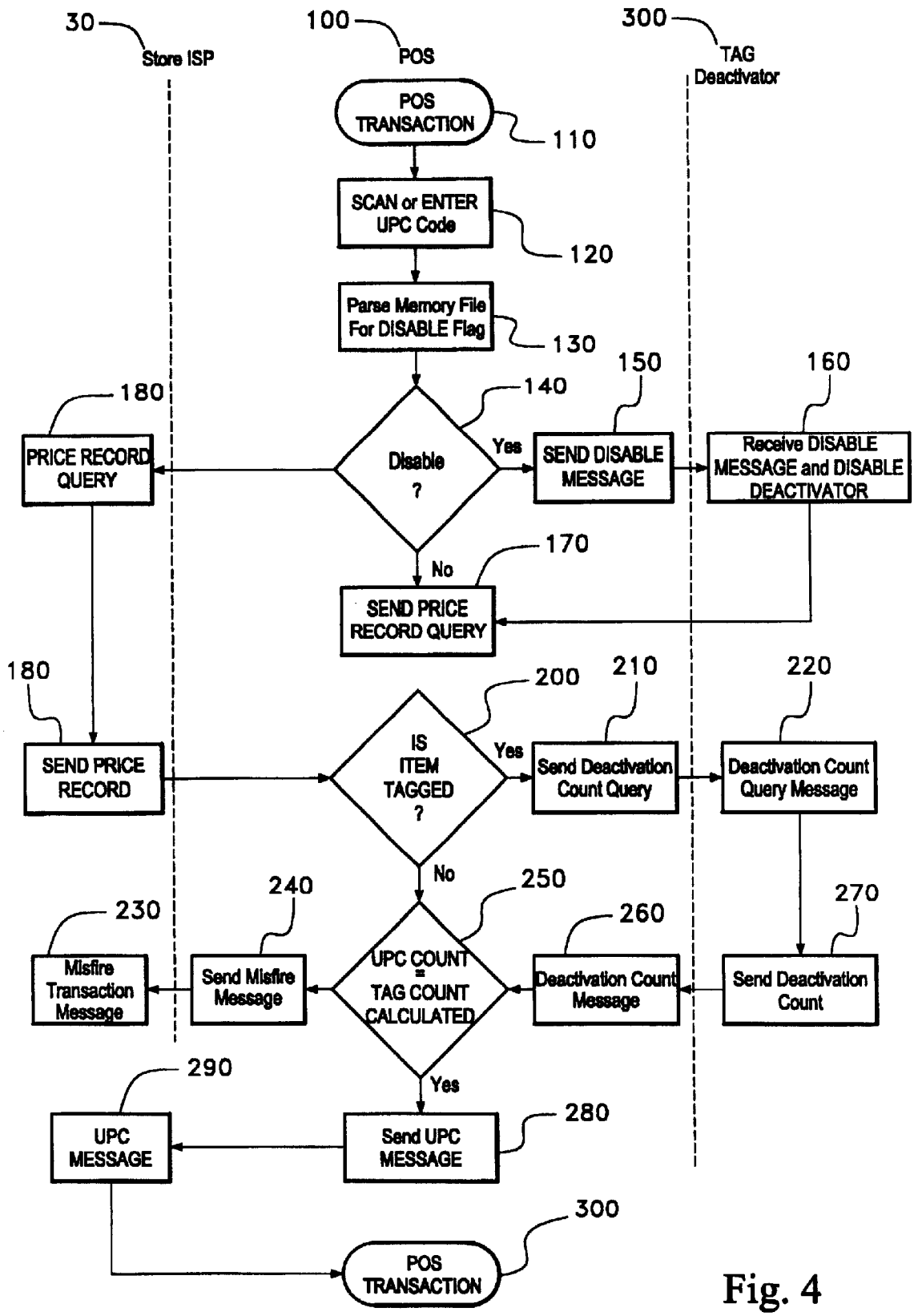
FIG. 4 is an exemplary flow diagram depicting the processing steps involved in performing UPC processing and tag deactivation and tracking according to a preferred embodiment of the present invention.

Referring now to FIG. 4, there is shown a flow chart indicating the processing flow and operation transactions between the POS computer 100, tag deactivator unit 300 and the in-store processor 30, for performing the UPC security tracking and tag deactivation processing embodied in the present invention. As previously mentioned, POS unit 100 initiates a transaction 110 by either scanning (via scanner 200) or entering a UPC code into memory (module 120). A list of UPC codes associated with merchandise items which do not have a security tag associated with them and/or should not be deactivated by the deactivator unit 300 are also stored in memory (e.g. in a flat file) within POS unit 100. Software within the system provides for the capability to determine what items should not be scanned or deactivated (such as magnetic tapes, film, etc.) This is implemented by downloading to POS 100 a set of UPC's which correspond to items which should or should not be deactivated. This list or flat file of UPC codes corresponding to items which should not be deactivated are stored in memory on POS 100 and the scanned or entered UPC code associated with the particular item being purchased is passed over the list to determine whether a match exists with one of the UPCs stored within the flat file (module 130). In a particular embodiment, this may be implemented by the memory file containing a list of UPC codes having a disable flag contained therein to indicate that these items should not be deactivated. The results of this memory parsing are returned to condition module 140. If a match has been found, the software operates to cause the POS to send a disable message (module 150) to the tag deactivator for disabling unit 300. Therefore in the disabled state, a subsequent scan or pass of the item of merchandise over the deactivator 300 by an operator, e.g. a sale associate, does not result in the item being subjected to the potentially harmful effects caused by the deactivation process. Also, no update in the deactivation count occurs. If no match is found, deactivator 300 remains active (or is enabled) so as to perform the deactivation process of a tagged item. FIG. 6 provides an example of enable, disable and request deactivation count messages from the POS 100 to the deactivator unit 300. As shown in FIG. 4, upon disabling the deactivator, or, if no UPC disable code match was found, a price record query (module 170) message is initiated by POS 100 and sent to store ISP unit 30. Note that the memory parsing step (module 130) occurs prior to the request price record (module 170). The price record is fetched from memory such as a database in the store ISP 30 and indicates the current price of the unit. The price record associated with the item corresponding to the current UPC code retrieved from the data store within ISP 30 is then transmitted via a send price record message (module 190) to POS unit 100. The price record contains a flag indicating whether or not the item returned is a tagged item. POS unit 100 reads the message from store ISP 30 including the set price record and determines whether or not the item is a tagged item (module 200). If the tagged item flag has been set within the send price record message, then the POS unit 100 sends a deactivation count query message (module 210) to tag deactivator 300. FIG. 6 illustrates exemplary types of messages between the POS processor and tag deactivator units. The deactivation count (module 260) returned by tag deactivator 300 is then compared at module 250 with the UPC count at POS 100 which corresponds to the number of particular UPCs scanned or entered into the POS 100 to determine whether the UPC count and calculated tag deactivation count match. If the UPC count and tag deactivation count are not equal, POS 100 sends a misfire, or exception message (module 230) to the store ISP 30 indicative of a misfire or exception transaction. That is, the system has determined a difference between the number of UPC counts scanned or entered into the POS 100 and the number of items that have been passed through the tag deactivator. If on the other hand, the item is not a tagged item, then processing proceeds to module 250. The UPC count and calculated tag count are compared to one another. If the counts are equal, a send UPC message indicating that the information associated with this UPC was scanned is sent to the store ISP for entry and update into the store ISP data base. The next POS transaction 300 is then initiated and processing proceeds in the same manner as described above.

Figure 5:
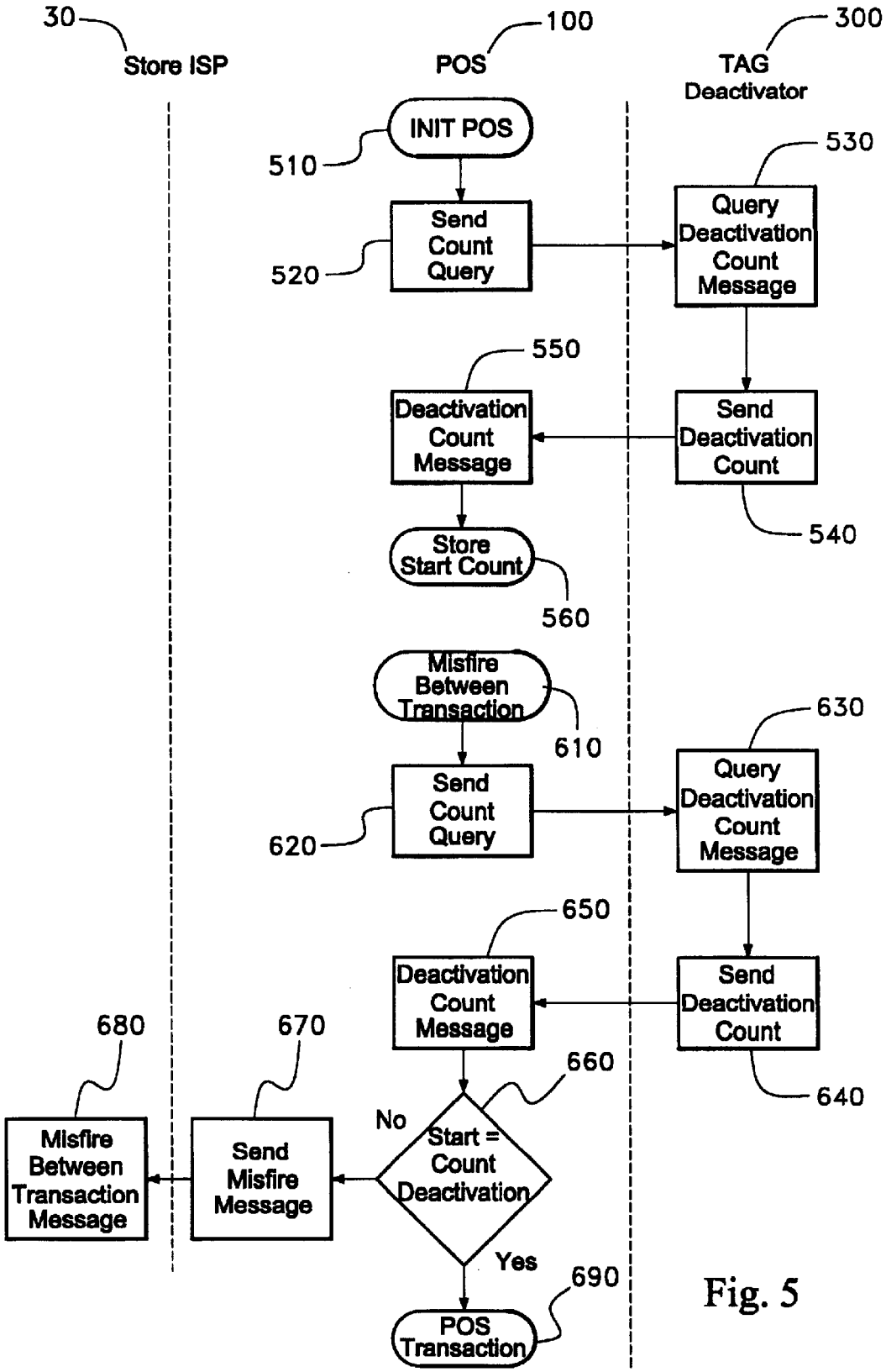
FIG. 5 is a processing flow diagram of the interaction between the POS computer unit and deactivator unit of the expert deactivation system for obtaining the current deactivation count according to a preferred embodiment of the present invention.

As shown in FIG. 5, when the POS 100 is initialized (module 510) a send count query 520 is submitted to tag deactivator unit 300 to obtain a current deactivation count. That is, the tag deactivator 300 is queried to determine the number of deactivations which it has presently stored in memory. The current deactivation count is then sent (module 540) to POS 100 to provide the current deactivation count value. The current count is then stored in memory in POS 100 (see module 560). This count may be defined as a start count. The start count stored in module 560 is then compared with a new count (or deactivation count) value stored in POS memory indicative of an initial transaction or a new transaction sequence. If the start count (module 610, 620) and deactivation count (modules 630 and 640) sent to the POS unit 100 are different (module 660), then a misfire message is sent from the POS to the store ISP to indicate that a deactivation has occurred outside the context of a scanned or UPC entered code. Such misfired data may be stored in the database to provide valuable statistical information regarding the tracking of deactivations outside the context of the present systems, i.e. exceptions. The misfire message may thus indicate that an actual transaction or purchase of merchandise was not obtained. In this manner, one may assume that between the context of the last sale that occurred, unauthorized transactions have occurred between the last initialization or the last query of the deactivation count. Upon initiation, the initial query deactivation count should be zero since no sales have occurred. In the next transaction the deactivation start count is known and stored in memory.

In summary then, when the POS 100 is initialized, the tag deactivator unit 300 is queried to obtain the current deactivation count. At the beginning of a transaction, the deactivator is again queried for the current deactivation count. If there have been any deactivations, a misfired between transactions message is sent to ISP 30. The UPC code is then scanned or entered at the POS unit 100. Upon entry of the UPC, a memory file within POS 100 containing a list of UPC codes corresponding to items which should not be passed through the scanner is parsed to determine if the tag deactivator unit should be disabled. The memory file contains UPC codes corresponding to items such as magnetic tapes, film and other merchandise that should not be scanned through the deactivator. A request is then sent to the ISP 30 from the POS unit 100 to obtain the price record associated with the UPC. The price record is fetched from memory and the record is returned to POS 100. The record contains a flag indicating whether or not the returned item is a security tagged item. The merchandise item should then be passed over the tag deactivator unit to cause an incremental change in the deactivation count (if the deactivator has not been disabled) and, at the next keystroke of the POS unit, a deactivation count query message is sent to deactivator 300 to obtain a current deactivation count. The quantity associated with the UPC code is then compared with the number of deactivations obtained via the deactivation count message. If the number of deactivations is different then the UPC count, a misfire message is sent to the ISP. A message is also sent for the UPC containing, date and time, quantity, tag status, deactivation status, associate, transaction, department, store and register. This sequence is then repeated for each UPC.

As shown in FIGS. 6–8, exemplary message types for messages between the ISP 30, POS 100 and tag deactivator 300 are provided. In one form of the present invention, all messages from the POS 100 include a packet header. Messages are preferably byte aligned and each message received from the POS 100 starts with the packet header followed by an addressed message header. A service request header then follows along with any data contained therein. FIG. 7A provides an exemplary packet header from the POS unit 100. Response from the ISP 30 includes an addressed message header followed by a service response header followed by any required data. FIG. 7B provides an exemplary illustration of the contents of an addressed message header. FIG. 7C provides an exemplary description of the contents associated with a service request header while FIG. 7D provides the fields corresponding to a service response header.

For service specific requests and responses, all messages received from the POS unit 100 begin with the service request header. The service ID and function ID in the header have been used to determine the type of message being received. Messages from the ISP 30 to the POS 100 carry at least a service response header. If no additional data in the message is present then such message is described as having no tail. The result field in the header is used by the POS unit 100 to determine the status of the request. The following sections describe message types and any additional data present following a service request or service response header in one embodiment.

Item Lookup Service ID=5 Function ID=80

This function performs a lookup of an item from the database. The response is data from the databases. If the record is not found in the database, the result field in the Service Response Header is set to NOT FOUND, and the response is sent with no tail. If found, the result field is set to FOUND, and the tail is set to the response format described below. The possible values for the result field in the Service Response Header are:

| | |
|---|---|
| FOUND | 0 |
| NOT FOUND | 5 |

The request data is illustrated in FIG. 8A while the response data is illustrated in FIG. 8B.

Get Load Status Service ID=18 Function ID=0

This function is used by the POS 100 to query the ISP 30 about the load status for the deactivator unit. The response is either no load requested or the information to load to the deactivator unit. The request data format is provided in FIG. 8C. The response data is illustrated in FIG. 8D.

Reset Load Status Service ID=18 Function ID=1

This function is used by the POS 100 to tell the ISP 30 to update the load requested status. The response has no tail. The request data is shown in FIG. 8E.

Tag Status Service ID=18 Function ID=2

This function is used by the POS 100 to send information to the ISP 30 about the last UPC scanned or a miscellaneous firing. The response has no tail. The request data is shown in FIG. 8F.

Reset Return Tag Status Service ID 18 Function ID=3

This function is used by the POS 100 to send information to the ISP 30 about returned items. The response has no tail. The request data is illustrated in FIG. 8G.

Reset Void Tag Status Service ID=18 Function ID=4

This function is used by the POS 100 to send information to the ISP 30 about voids. The response has no tail. The request data is illustrated in FIG. 8H.

As one can ascertain from the above discussion, software within the POS provides for various functional capabilities, including security, information management, diagnostics and messaging operations. For example the POS Enable/Disable function provides initial activation and subsequent deactivation of the tag deactivator device upon valid operator (e.g. sales associate) log-on and log-off respectively. A valid sales associate operator log-on will send logic level signal from the POS 100 to the deactivator 300, which will then be enabled. A sales associate log-off will send a logic level signal from the POS 100 to the deactivator 300 which will then be disabled.

The Scan Enable function operates while a bar code reader is connected to the POS 100, the valid read of a bar-coded label is the function of the bar-code scanner and not the POS 100 (the scanner performs the read and sends the data to the POS). In this case the POS 100 is merely recording whether or not the item scanned is in the Price Lookup (PLU) file. The signal to enable the tag deactivator device 300 comes directly from the bar-code scanner, and not the POS 100. In addition, the deactivator 300 operates to disable itself based upon timing parameters following each valid deactivation of a tag or security device.

An alternate method for handling Scan Enable is to have the POS 100 perform a price lookup when it receives the input from the bar-code scanner, return the price and send the logic level signal to enable the deactivator 300. In this scenario signal propagation occurs from the bar-code scanner to the POS 100, up to the server PLU file and back down to the deactivator 300 for activation.

The Keyboard Enable function requires intervention of the POS 100 in order to control the sending of the logic level signal to the deactivator 300. Otherwise, the signal would be sent each time the POS 100 enter key was pressed during a POS transaction. An exemplary implementation of the Keyboard Enable feature is as follows: First, the POS 100 requests a UPC. The UPC is keyed rather than scanned.

The Enter key is pressed and based upon the a UPC being the last requested entry, the POS 100 will send a logic level signal to enable the deactivator 300. Note that, just as in the Scan Enable, it is not necessary to wait for UPC validation from the price file. It is only necessary that the item entered pass any algorithm check within the UPC itself. This is because the item identifier may be valid, it may not necessarily be in the price file yet. The deactivator 300 disables itself based upon a reasonable timing parameter when no tag is detected within a predetermined number of seconds, or following each valid deactivation of a merchandise tag, i.e. security device.

The Scan Inhibit function represents the first instance that the POS 100 is required to perform a lookup in order to determine whether to activate/deactivate the deactivator device 300. This is due to the necessity of knowing the category of the item being processed. An exemplary scenario is as follows. When an operator (i.e. sales associate) scans or keys an item, the POS 100 performs a lookup PLU. Since it is anticipated that scan inhibited items will be relatively few, and that PLUs to files on the server may cause timing issues, these items are held in local POS 100 memory in order to speed up the lookup process.

If the item scanned is of a category of items that will not be tagged for deactivation, due to potential damage to the item by the deactivation process, no logic level signal will be sent to the deactivator 100 for activation. If no hit is found in the local PLU file, then the logic level signal is sent from the POS 100 to enable the deactivator.

A Self-Checkout function represents functionally similar to the Scan Enable and Keyboard Enable functions, with the single addition of a Customer prompt at the device (POS 100 or hand held scanner with display capability) informing the user (customer) to present the item to deactivator 300 for deactivation, or when valid to include Scan Inhibit.

A Label Tracking function allows predefined labeled items in the retailer's database to be linked with appropriate SKU's in the database allows for accurate tag tracking, without a specific tag identifier, e.g., serial number, and achieves an assumption of compliance. That is, when a bar code is scanned, a PLU lookup can be performed and it can be noted that the UPC in question should have a tag, however, there is no positive way to tell that the next tag deactivated is with the appropriate SKU. That said, however, positive benefits can be achieved through nightly audit comparisons of UPC's scanned and tags deactivated. This provides a retailer with information (within predefined limits) that vendors are in tag compliance. This may be accomplished by using an RS-232 interface. When a sales associate scans or keys item, based upon the fact that an UPC was entered, the POS 100 will send a logic level signal to enable the deactivator 300. If the item scanned is of a category of items that will not be tagged for deactivation, due to potential damage to the item by the deactivation process, no logic level signal will be sent to the deactivator for activation (see Scan Inhibit). If no hit is found in the local PLU file in memory then the logic level signal will be sent from the POS 100 to enable the deactivator 300. Upon deactivation, the deactivator 300 will send a logic level signal back to the POS 100 indicating deactivation has occurred. This message will be appended to the POS transaction for transmission to the server and subsequent storage in the appropriate database(s). The tag tracking information being transmitted to the server is based upon the assumption that the item deactivated is associated with the previous item scanned at the POS 100.

In order to prevent item switching (scanning a low priced item and then deactivating more expensive merchandise) the server database will need to contain all items and their tag status, i.e., whether the item should be tagged or not tagged. The process would be similar to Scan Inhibit, however, it is assumed that the size of the files to be checked would be too large to hold locally (at the POS), and therefore, that each scan would require a database search. The POS enabled or disabled message for providing initial activation and subsequent deactivation of the deactivator unit 300 operates to prevent the deactivator 300 from interfering with any electronic peripherals electronic or magnetic peripherals such as a magnetic stripe reader to ensure that both devices operate exclusive of one another. In general, an on/off trigger operates in a manner such that a magnetic stripe reader associated with POS 100 may remain disabled until a particular option such as a tender credit "credit" is selected. Upon selection of a tender credit at the POS 100, POS 100 will enable the MSR and send a logic level signal to the deactivator unit 300 to cause disabling of the unit 300. When the activity is terminated at the POS 100, POS 100 will disable the MSR and send a logic level signal to the deactivator unit 300 causing enablement of the unit. The same process may be used to enable or disable other peripheral devices such as a penpad and card reader and the deactivator unit 300 for debit card transactions.

While the foregoing invention has been described with reference to the above embodiments, various modifications and changes can be made without departing from the spirit and scope of the invention as hereinafter claimed. It is intended that the patent shall cover by suitable expression in the appended claims, whatever features of patentable novelty exist in the invention disclosed.

We claim:

1. A system for tracking deactivation of security devices being associated with items to be sold, said system comprising:

an item logging device for entering identification data for each of said items to be sold;

a deactivation device for deactivating said security devices; and, database means for storing data indicative of which of a plurality of items should or should not include at least one of said security devices to be deactivated by said deactivation device;

wherein said deactivation device is selectively operable automatically in response to operation of said item logging device and said stored data.

2. The system of claim 1, wherein, when said item logging device identifies data, operation of said deactivation device is responsive to a state of said data stored in said database means.

3. The system of claim 2, wherein said state of said data stored in said database means is indicative of whether an item associated with said state should include at least one security device to be deactivated.

4. The system of claim 1, wherein said item logging device is a POS terminal, and said deactivation device uses degaussing to deactivate a magnetic security device or an RF signal to resonate a security device.

5. The system of claim 1, further comprising means for determining an expected number of operations by said deactivating device responsively to said data logging device and said database.

6. The system of claim 5, further comprising means for at least temporarily storing data being indicative of a transaction where a number of operations of said deactivating device differs from said expected number.

* * * * *